US008870112B2

(12) United States Patent
Åkerlund

(10) Patent No.: US 8,870,112 B2
(45) Date of Patent: Oct. 28, 2014

(54) SET CHANGING DEVICE OF A SLITTER-WINDER

(75) Inventor: Kenneth Åkerlund, Helsinki (FI)

(73) Assignee: Valmet Technologies, Inc., Espoo (FI)

( * ) Notice: Subject to any disclaimer, the term of this patent is extended or adjusted under 35 U.S.C. 154(b) by 174 days.

(21) Appl. No.: 13/511,323

(22) PCT Filed: Nov. 5, 2010

(86) PCT No.: PCT/FI2010/050896
§ 371 (c)(1),
(2), (4) Date: May 22, 2012

(87) PCT Pub. No.: WO2011/061389
PCT Pub. Date: May 26, 2011

(65) Prior Publication Data

US 2012/0234962 A1 Sep. 20, 2012

(30) Foreign Application Priority Data

Nov. 23, 2009 (FI) ..... 20096228

(51) Int. Cl.
*B65H 19/22* (2006.01)

(52) U.S. Cl.
USPC ..... 242/533; 242/542; 242/542.2; 242/542.3

(58) Field of Classification Search
USPC ..... 242/533, 542, 542.2–542.3
See application file for complete search history.

(56) References Cited

U.S. PATENT DOCUMENTS

| | | | | |
|---|---|---|---|---|
| 3,345,010 | A | 10/1967 | Egan | |
| 4,456,190 | A * | 6/1984 | Karttunen et al. | 242/527.3 |
| 4,516,735 | A * | 5/1985 | Snygg | 242/527.3 |
| 4,789,109 | A * | 12/1988 | Kyytsonen et al. | 242/527 |
| 4,842,209 | A * | 6/1989 | Saukkonen | 242/527.3 |
| 5,911,384 | A | 6/1999 | Peters | |
| 6,926,224 | B2 * | 8/2005 | Fohr et al. | 242/527.2 |

FOREIGN PATENT DOCUMENTS

| | | |
|---|---|---|
| DE | 29719544 U1 | 2/1998 |
| EP | 0905070 A1 | 3/1999 |
| EP | 1373111 A1 | 1/2004 |
| EP | 1954614 B1 | 10/2011 |
| FI | 118762 B1 | 3/2008 |
| FI | 20096228 | 11/2009 |
| WO | 2011061389 | 5/2011 |

OTHER PUBLICATIONS

International Search Report for PCT/FI2010/050896 dated Feb. 3, 2011.
Written Opinion of the International Searching Authority for PCT/FI2010/050896 dated Feb. 3, 2011.

* cited by examiner

*Primary Examiner* — Sang Kim
(74) *Attorney, Agent, or Firm* — Stiennon & Stiennon

(57) ABSTRACT

A set changing device of a slitter-winder has a pusher device for pushing completed wound fiber web rolls (10) of partial webs cut with a slitter-winder and carried by carrier means (11, 18') forward from the winding-up section (1). The pusher device has at least two press rolls. The position of at least one of the press rolls (2, 3) with respect to the body (17) of the pusher device (6) is arranged to change during pushing.

11 Claims, 3 Drawing Sheets

Fig. 2A Prior Art
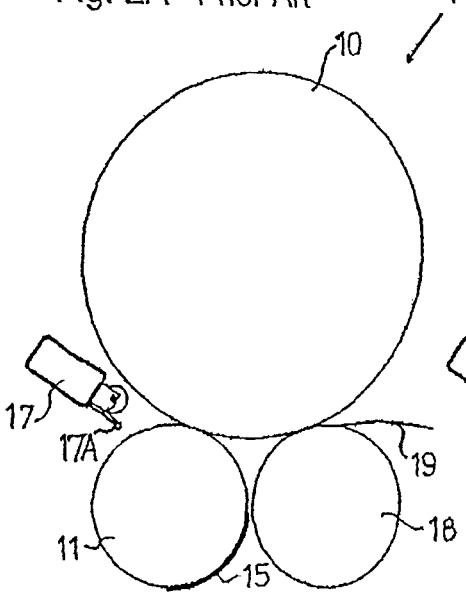
Fig. 2B Prior Art
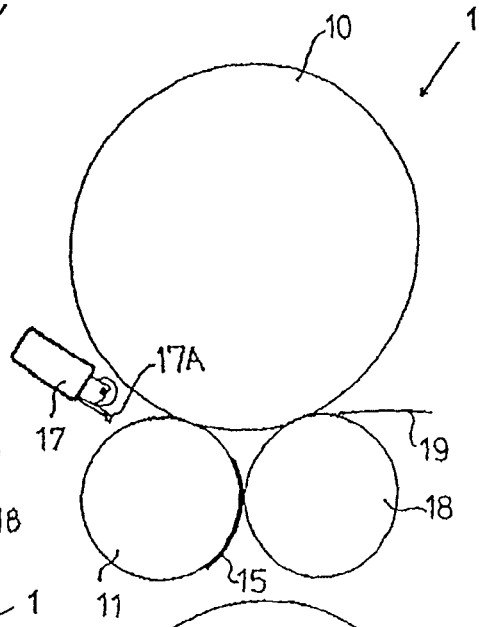
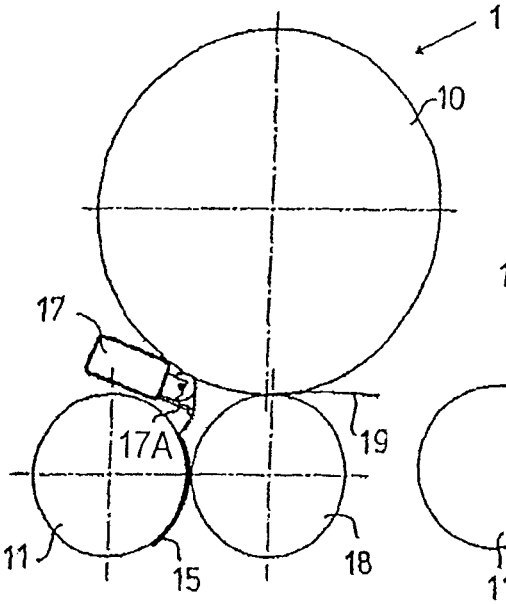
Fig. 2C Prior Art
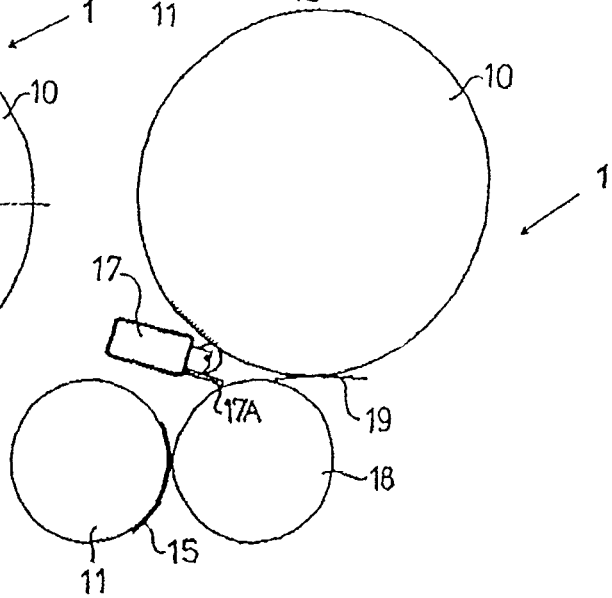
Fig. 2D Prior Art

SET CHANGING DEVICE OF A SLITTER-WINDER

CROSS REFERENCES TO RELATED APPLICATIONS

This application is a U.S. national stage application of International App. No. PCT/FI2010/050896, filed Nov. 5, 2010, the disclosure of which is incorporated by reference herein and claims priority on Finnish App. No. 20096228, filed Nov. 23, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a set changing device of a slitter-winder, comprising a pusher device for pushing completed wound fiber web rolls of partial webs cut with a slitter-winder and carried by carrier rolls forward from the winding-up section.

By means of the slitter-winder, the fiber web is cut in the longitudinal direction into parallel partial webs, which partial webs are wound on the winding-up section carried by the front and rear carrier rolls into successive rolls, that is, a set in the transverse direction of the fiber web. As a carrier roll may also be used a belt arrangement provided around two leading rolls, that is, a so-called set of belt rolls. Set change refers to a stage in roll manufacture at which, before starting new winding, the winding has to be stopped, the web cut at the winding-up section and the set, that is, the completed wound partial web rolls removed, and once new cores have been positioned in the winding-up section, the winding of a new set is started.

A problem with the winding-up sections known from the prior art is the reliable fastening of the tail of the partial web rolls being wound, that is, of each fiber web roll being completed. For fastening the tail of a fiber web roll being completed, that is, the tail end of a web being wound, has been used a method in which glue stripes are applied on the web before the winding-up nip and the glue stripes have been run almost completely inside the roll through the winding-up nip before stopping the winding-up section. The fiber web roll is in contact with both the rear carrier roll and the front carrier roll (or the set of belt rolls), whereby the glue is pressed fast in the winding-up nip between the rear carrier roll and the fiber web roll being formed. This causes a problem to the glue stripe that has passed through the nip at the stage when the completed fiber web rolls are pushed out of the winding-up section, because the glued web may open from the roll. With certain web grades, especially heavy grades such as board webs, an opening web causes splitting in the glue stripe area, that is, the glue no longer gives in but the surface layer of the web detaches with the glue instead of the glue stripe opening within the glued area. The split glue stripe will no longer adhere and the gluing thus remains incomplete for this part. The insufficient fastening of the web end may cause the tail to open partly or completely, which in turn causes problems in measurements and in the transport and further processing of the fiber web roll. A completely opened tail will cause problems in a high-rise store house of rolls, where rolls are kept in a vertical position in stacks of several rolls. On the other hand, when winding thin fiber web rolls, a problem may be caused by the pressing action of the nip, due to which the glue may be pressed through several web layers. Another known method is one where the set is lifted off the rear roll and following the cutting of the web, the set is swivelled on the front roll in such a way that the tails are pressed fast on the nip of the roll pusher. The problem with this method is that it takes up extra time and thus reduces the capacity of the cutter.

To solve this problem, a working solution as such is described in Metso Paper, Inc.'s earlier Finnish patent publication FI118762. FIGS. 2A-2D show diagrammatic side views of the winding-up section of the slitter-winder disclosed in the publication FI118762 at different stages of winding. FIGS. 2A-2D show diagrammatically a roll pusher 17, which is fitted in such a way that the tail glued to the roll 10 is wound fast on the surface of the roll in a controlled way by the pushing motion of the roll pusher 17. The roll pusher 17 is designed and fitted to move so as to provide an adequate cutting angle for the web against the cutting blade 15 during the pushing out. The roll pusher 17 is equipped with a guide part 17A by means of which a small roll can be pushed out of the winding assembly without a remover device of small rolls connected to the pusher and moved by a separate actuator. In the situation shown in FIG. 2A, the fiber web roll 10 is about to be completed and in FIG. 2B, the cutting blade 15 has been lifted to the cutting position adjacent to the rear carrier roll 11. In the situation shown in FIG. 2C, the completed fiber web roll 10 is pushed by the roll pusher 17 towards the top of the front carrier roll 18, whereby the cutting blade 15 cuts the web W. At the stage shown in FIG. 2D, the roll pusher 17 pushes the completed roll to the lowering device 19.

A problem with this solution is that the mass of the set is received by one row of press rolls in the pusher 17, which means that the tip of the pusher unavoidably becomes relatively thick in order for it to withstand the mass of the set. This results on the one hand in the roll 10 possibly escaping from the carrier rolls 11, 18 before the row of press rolls on the pusher presses the tail fast against the fiber web roll 10. Pressing the tail fast requires that the lowering device 19 is realized as an uphill-type device, for example, as an uphill tipper, where the pressing fast of the tail can be continued. In connection with new machines this is relatively easy to carry out, but in modernizations the conversion of the lowering device 19 into an uphill-type one substantially increases the cost of the product improvement. Furthermore, a single row of press rolls has been noted to mark the surface of the fiber web roll.

SUMMARY OF THE INVENTION

The aim of the present invention is to provide a solution by means of which the disadvantages of the prior art set changing device are avoided and the modernization work can be done at a reasonable cost.

To achieve this aim, the set changing device according to the invention is characterized in that the pusher device comprises at least two press rolls and that the position of at least one of the press rolls with respect to the body of the pusher device is arranged to change during pushing. The pusher device preferably comprises two rows of press rolls formed into a bogie structure (i.e., a wheel truck) in such a way that the rows of press rolls are in contact with the fiber web roll at the same time as the fiber web roll is being pushed at least partly out of the winding-up section.

One of the advantages of the solution according to the invention is that the bogie structure is designed so as to divide the mass of the set between two rows of press rolls, of which the front row of press rolls carries less mass so that it may be designed to be smaller than the rear one. This makes it possible to bring the front row of press rolls further forward, whereby the tail of the roll can be pressed fast before the highest point of the front carrier roll. This reduces the extent of modernization, thus reducing costs.

According to a preferred embodiment of the invention, the set changing device comprises a means which changes the length of travel of the web, which varies the length of travel of the web depending on the lateral point on the web. The means changing the length of travel is, for example, curved in design so that the cutting of the fiber web can be made to start from the center and to proceed towards the edges, whereby the force exerted by the cutting on the cutting blade is reduced. The means changing the length of travel may also be conical or comprised of segments. In connection with this means may in addition be provided means for switching the said means on/off. This type of arrangement is also applicable to other types of set changing devices in addition to the one according to the invention.

BRIEF DESCRIPTION OF THE DRAWINGS

The invention is described in greater detail in the following, with reference to the accompanying drawings, in which:

FIG. 2A shows a diagrammatic view of a prior art set changing apparatus of a slitter-winder at a winding-up section where the fiber-web roll is being completed.

FIG. 2B shows the prior art apparatus of FIG. 2A where a cutting blade has been lifted to the cutting position.

FIG. 2C shows the prior art apparatus of FIG. 2A where the complected fiber-roll is pushed by a roll pusher toward the top of a front carrier roll, wherein the cutting blade cuts the web and a guide part ensures the accurate path of the web.

FIG. 2D shows the prior art apparatus of FIG. 2A where the roll pusher pushes the completed fiber-roll to a lowering device.

DESCRIPTION OF THE PREFERRED EMBODIMENTS

Figure 1:
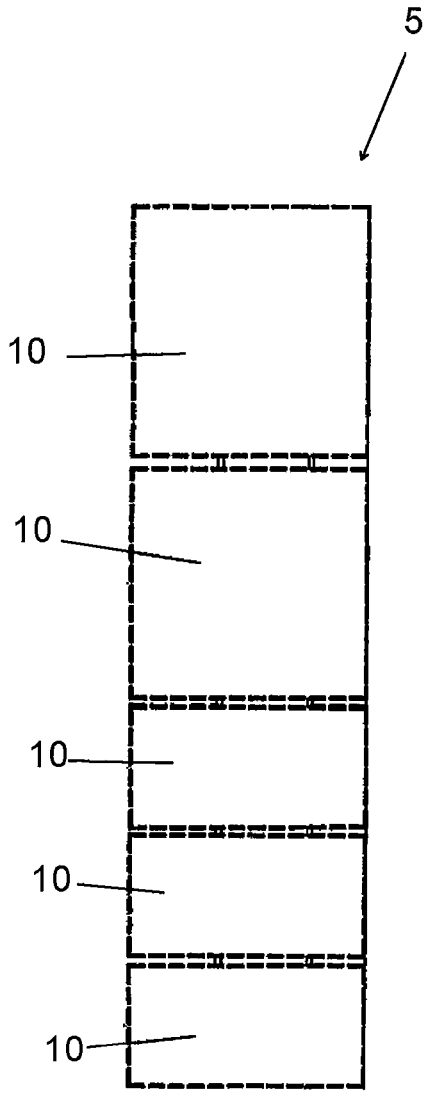
FIG. 1 shows a diagrammatic view in principle of the set.

FIG. 1 shows a diagrammatic top view of a set 5 comprising transversely successive partial web rolls 10 which are of various widths in the embodiment shown.

Figure 3:
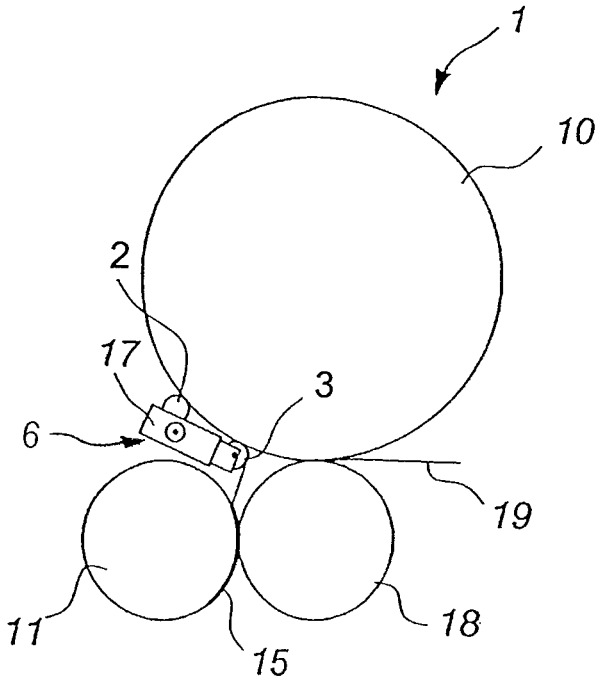
FIG. 3 shows a diagrammatic view in principle of a set changing apparatus of a slitter-winder at a winding-up section according to the invention.

FIG. 3 shows a diagrammatic view in principle of an embodiment of the set changing device according to the invention. In accordance with FIG. 3, the device 1 includes a pusher device 6 which comprises two rows of press rolls 2, 3, of which the front row of press rolls 3 is dimensioned to be smaller in diameter than the rear row of press rolls 2. The rear row of press rolls 2 is dimensioned to carry a greater part of the mass of the fiber web roll 10. The bogie structure is arranged to follow the surface contour of the roll during the pushout motion or at least a part of it.

The bogie may be arranged to be turned by an actuator or, for example, by a spring. The bogie may be arranged to turn as synchronized by the pushout motion of the fiber web roll. The bogie may be arranged to turn by contact externally of the pusher device, for example, an end stopper may be arranged in the end position and turn the bogie. In the bogie may be constructed with damping and/or spring elements to affect its turning motion.

Figure 4:
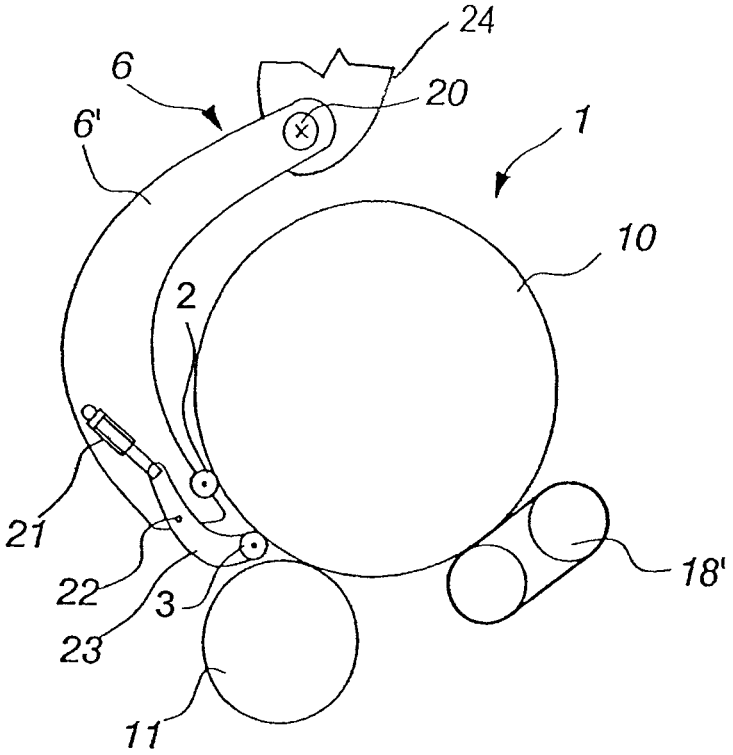
FIG. 4 shows a diagrammatic view in principle of another set changing apparatus of a slitter-winder according to the invention.

FIG. 4 shows another embodiment of the set changing apparatus of a slitter-winder according to the invention, where the pusher device 6 is arranged to pivot on a body structure 24 by an articulated joint 20 and the front row of press rolls 3 is connected by an articulated arm 23 to the body part 6' of the pusher device 6 at the pivot 22. In the embodiment shown, the articulated arm is connected to an actuator 21 which may be, for example, a hydraulic cylinder. In the embodiment of FIG. 4, a set of belt rolls 18' acts as the front carrier roll.

The front row of press rolls is preferably curved, so that the cutting of the fiber web is made to start, for example, on the edges and to proceed towards the center or to start in the center and to proceed towards the edges, whereby the force exerted by cutting on the cutting blade decreases. In this way is achieved a means for changing the length of travel of the web, which may also be conical or partly conical/curved or be comprised of, for example, segments. This arrangement is also applicable to set changing devices where the pusher device only comprises one press roll. The means for changing the length of travel of the web may also be implemented as a separate means which can be positioned, for example, in the vicinity of the press roll of a pusher device, or it may be modified from a means by which small rolls are also removed. The means may comprise a device for switching it on/off, for example, pushing means.

The invention claimed is:

1. A set changing device of a slitter-winder, comprising:

a rear carrier roll, and a front carrier roll arranged one after the other, and forming a winding-up section and arranged to receive partial webs cut with a splitter and to wind said received partial webs to form wound fiber web rolls of the partial webs cut with the slitter-winder, wherein the rear carrier roll is closer to said splitter than the front carrier roll is;

a lowering device which extends downwardly from a highest point of the front carrier roll, the lowering device being in roll receiving relation to the front carrier roll;

a pusher device mounted for pushing wound fiber web rolls of partial webs cut with the slitter-winder from the winding-up section;

a cutting blade mounted liftable to a cutting position adjacent to the rear carrier roll;

wherein the pusher device further comprises:

a body operable to push the wound fiber web rolls at least partly out of the winding-up section;

a rear row of press rolls near the slitter and a front row of press rolls further from the slitter, said rear and front press rolls mounted to the body and arranged to simultaneously engage the wound fiber web rolls; and wherein at least the front row of press rolls is mounted with respect to the body of the pusher device to change position during an interval when the pusher device is operated to push wound fiber web rolls at least partly out of the winding-up section;

wherein the front row of press rolls on the pusher device is arranged to fold a partial web of said wound fiber rolls of partial webs over the cutting blade so the web is cut; and wherein the front row of press rolls on the pusher device is arranged to move forward, wherein a tail formed by the web can be pressed fast to a wound fiber web roll before the wound fiber web roll passes over the highest point of the front carrier roll.

2. The set changing device of claim 1 wherein a set of belt rolls forms the front carrier roll.

3. The set changing device of claim 1 wherein the pusher device comprises the two rows of press rolls formed into a wheel truck in such a way that the two rows of press rolls are in contact with the fiber web roll when the fiber web roll is pushed at least partly out of the winding-up section.

4. A set changing device of a slitter-winder, comprising:

a fiber web forming a plurality of partial fiber webs;

a rear carrier roll, having a rear carrier roll surface about which the partial webs wrap;

a cutting blade arranged to move circumferentially about the rear carrier roll;

a front carrier roll or a pair of belt rolls, wherein the rear carrier roll, and the front carrier roll or parallel belt rolls define a wind-up section;

wherein the front carrier roll or pair of belt rolls has a highest point;

a plurality of partial fiber web rolls, each partial fiber web roll defining a mass, and a tail after the cutting blade cuts the plurality of partial fiber web rolls from the fiber web;

wherein each partial fiber web is arranged to wrap around the first carrier roll and onto one of the plurality of partial fiber web rolls, when the partial fiber web rolls are supported on the first carrier roll and the second carrier roll or pair of belt rolls;

a lowering device arranged in partial fiber web roll receiving relation to the second carrier roll or pair of belt rolls after the plurality of partial fiber web rolls pass the highest point;

a pusher device having a body and mounted thereto two rows of press rolls, a front row of press rolls closest to the lowering device, and a rear row of press rolls further from the lowering device, the two rows of press rolls forming a wheel truck in such a way that the two rows of press rolls are arranged to move in contact with the partial fiber web rolls when the partial fiber web rolls are pushed at least partly out of the wind-up section;

wherein the position of at least one of the two rows of press rolls is arranged to change during pushing with respect to the body of the pusher device so that the masses of the partial fiber web rolls are divided between the two rows of press rolls so that the front row of press rolls carries less mass during pushing of the partial web rolls onto the lowering device, so that the front row of press rolls can be brought further toward the lowering device, and the tails of the partial fiber webs can be pressed fast before the partial fiber webs reach the highest point of the front carrier roll or pair of belt rolls.

5. The set changing device of claim 4 wherein the press rolls of the front row of press rolls have smaller diameters than the press rolls of the rear row of press rolls.

6. The set changing device of claim 4 wherein the front row of press rolls is curved.

7. The set changing device of claim 4 wherein the pusher device is fixed to a body structure in an articulated manner.

8. The set changing device of claim 4 wherein the pivot point of a body part of the pusher device is arranged at a distance from a center defined by the rear carrier roll.

9. The set changing device of claim 4 wherein the wheel truck is arranged to turn by a separate actuator.

10. The set changing device of claim 4 wherein the lowering device does not extend upwardly.

11. The set changing device of claim 4 wherein the front row of press rolls is curved, so that the cutting of the fiber web is made to start on the edges and to proceed towards the center or to start in the center and to proceed towards the edges, minimizing forces exerted by the cutting blade.

* * * * *